US007295165B2

(12) United States Patent
Ferguson et al.

(10) Patent No.: US 7,295,165 B2
(45) Date of Patent: Nov. 13, 2007

(54) PHASED ARRAY ANTENNA CHOKE PLATE METHOD AND APPARATUS

(75) Inventors: Stanley D Ferguson, Renton, WA (US); David N Rasmussen, Renton, WA (US); Michael J Taylor, Sumner, WA (US)

(73) Assignee: The Boeing Company, Chicago, IL (US)

( * ) Notice: Subject to any disclaimer, the term of this patent is extended or adjusted under 35 U.S.C. 154(b) by 119 days.

(21) Appl. No.: 11/212,399

(22) Filed: Aug. 26, 2005

(65) Prior Publication Data

US 2006/0238427 A1 Oct. 26, 2006

(51) Int. Cl.
*H01Q 1/28* (2006.01)

(52) U.S. Cl. ..... 343/705; 343/785

(58) Field of Classification Search ..... 343/705, 343/708, 711, 785, 786, 767, 829, 846
See application file for complete search history.

(56) References Cited

U.S. PATENT DOCUMENTS 4,897,663 A * 1/1990 Kusano et al. ..... 343/786
5,132,698 A 7/1992 Swineford
6,040,805 A * 3/2000 Huynh et al. ..... 343/785
6,414,644 B1 7/2002 Desargant et al.
2004/0108963 A1 6/2004 Clymer et al.

OTHER PUBLICATIONS

PCT Search Report for PCT/US2006/007808 filed Jun. 3, 2006.

* cited by examiner

*Primary Examiner*—Tan Ho
(74) *Attorney, Agent, or Firm*—Harness, Dickey & Pierce, P.L.C.

(57) ABSTRACT

A phased array antenna system on an aircraft that incorporates a choke plate that significantly attenuates sidelobes of the antenna beam pattern at elevation angles that would cause RF interference with ground-based terrestrial wireless networks. The choke plate includes a plurality of choke grooves that substantially circumscribe the antenna aperture. The choke plate has an upper surface that is positioned generally coplanar with the upper surface of the antenna aperture. The grooves of the choke plate may be filled with a dielectric material. The choke plate provides a smooth aerodynamic component that significantly attenuates beam scattering, and thus the radiation pattern sidelobes of the antenna at or below the horizon, when the aircraft is in flight.

18 Claims, 12 Drawing Sheets

PHASED ARRAY ANTENNA CHOKE PLATE METHOD AND APPARATUS

CROSS-REFERENCE TO RELATED APPLICATIONS

This application claims priority to U.S. provisional application No. 60/673,846 filed on Apr. 22, 2005, the disclosure of which is incorporated herein by reference.

FIELD OF THE INVENTION

The present invention relates to phased array antennas. More specifically, this invention relates to structures and method for controlling the shape of the radiation pattern side lobe features of antennas, and particularly phased array antennas.

BACKGROUND OF THE INVENTION

Airborne satellite communication systems generally require an externally-mounted antenna unit. To achieve broadband data rates, a high-gain antenna is typically required, resulting in a significant aperture size. This structure is typically mounted on the top of the mobile platform, for example, on the crown of the fuselage of an aircraft. The structure is typically covered by an aerodynamically-shaped fairing having small frontal areas. Additional requirements are imposed by regulatory agencies to obtain spectrum authorization by the Federal Communications Commission (FCC) or equivalent in foreign jurisdictions.

One such requirement precludes interference with terrestrial wireless services. To provide a design that complies with FCC and European Telecommunication Standards Institute (ETSI) regulations, for example, requires reduction of the transmit antenna horizon and below-horizon sidelobe levels. FIG. 1 illustrates this problem. At a cruise altitude represented by line A, the sidelobe radiation of a crown-mounted antenna may irradiate the Earth, as represented by arc B. The sidelobe attenuation needs to be sufficient such that substantially no radiation extends beyond the arc labeled C. Current designs generally do not meet these requirements.

A solution proposed in the past has included an external choke plate to reduce radio frequency scattering near, at or below the horizon. This solution has not been acceptable for high-speed aircraft installations because such choke designs are exposed to the air stream and are susceptible to environmental issues such as corrosion and debris contamination. Such structures also have detrimental or unacceptable effects on aerodynamic drag, noise and vibration.

The apparatus and method of the present invention addresses considerations such as radiation pattern sidelobe requirements at, below and near the horizon for airborne mobile platforms to enable such mobile platforms to meet regulatory requirements.

SUMMARY OF THE INVENTION

The present invention involves an antenna system incorporating a choke plate and method for attenuating radio frequency (RF) sidelobes of an antenna mounted externally on an aircraft, where RF interference considerations with terrestrial-based RF networks is important. The choke apparatus of the present invention sufficiently attenuates the sidelobes of the antenna aperture with which it is used to avoid significant RF radiation below the horizon when an airborne mobile platform on which the antenna system is in flight.

In one preferred form, the choke apparatus comprises a choke plate and a plurality of parallel grooves formed in a surface thereof. In one preferred form the grooves are formed in an upper surface and are arranged in a plurality of groups. The choke plate includes an opening within which the antenna aperture resides, such that the aperture is at least substantially circumscribed by the choke plate. The grooves on the choke plate may be filled with a dielectric to further tune the performance of the choke plate, as well as to provide a more aerodynamic surface.

The choke plate is suitable for use on high-speed mobile platforms, such as commercial jet aircraft, without tangibly degrading the aerodynamic performance of the aircraft.

The features, functions, and advantages can be achieved independently in various embodiments of the present inventions or may be combined in yet other embodiments.

BRIEF DESCRIPTION OF THE DRAWINGS

The present invention will become more fully understood from the detailed description and the accompanying drawings, wherein:

FIG. 1 is a diagram illustrating an antenna on an aircraft transmitting a signal that impinges the Earth, as well as an arc that illustrates what the maximum radiation pattern needs to be limited to;

DETAILED DESCRIPTION OF THE PREFERRED EMBODIMENTS

The following description of the preferred embodiment(s) is merely exemplary in nature and is in no way intended to limit the invention, its application, or uses.

Figure 1:
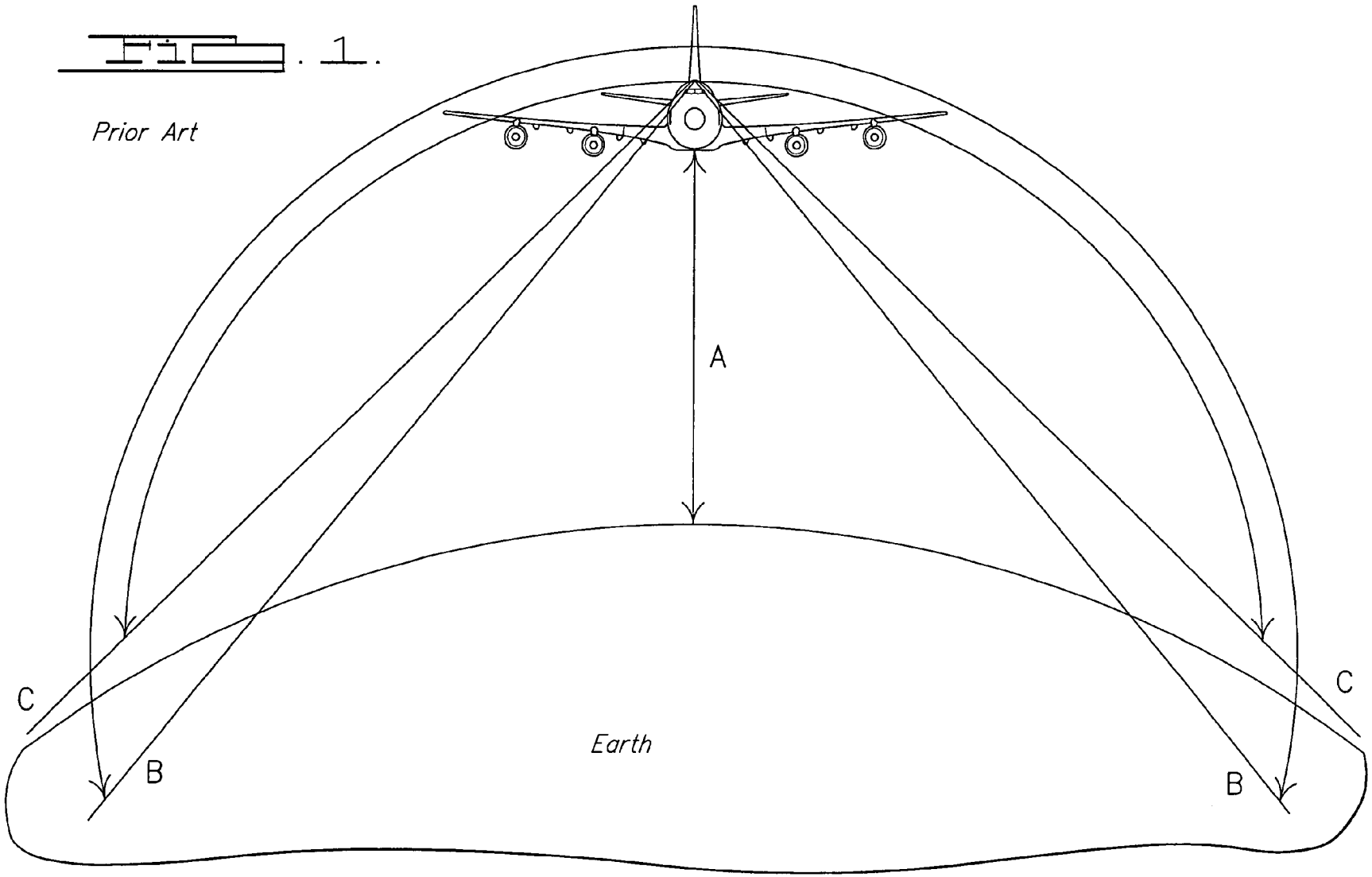
FIG. 1. Prior Art
Figure 1A:
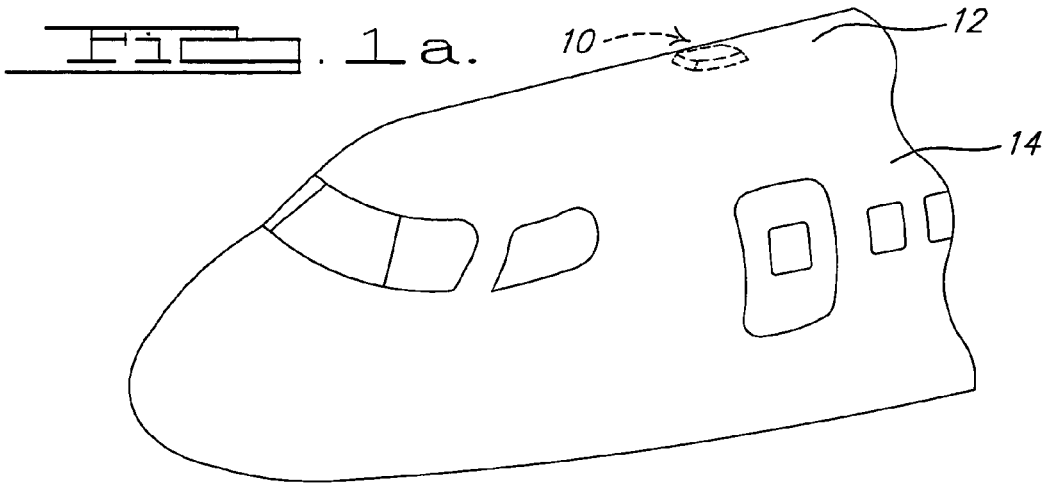
FIG. 1*a* is a perspective view of a portion of an aircraft illustrating an antenna system installed on the crown of the aircraft, where the antenna system includes a preferred embodiment of the choke plate of the present invention.

Referring to FIG. 1*a*, there is shown an antenna system 10 in accordance with a preferred embodiment of the present invention. The antenna system 10 is located, in this example, on an external surface of a mobile platform 12. In this example, the mobile platform 12 forms a commercial aircraft, and the antenna system 10 is located on an external surface of the fuselage 14 on the crown of the fuselage. It will be appreciated, however, that the antenna system 10 could be used on any form of airborne mobile platform, or possibly even on any form of marine vessel or land vehicle. Essentially, any vehicle having an antenna mounted thereon where controlling the sidelobes of the beam projected from the antenna is an important consideration, could potentially make use of the invention.

Figure 2:
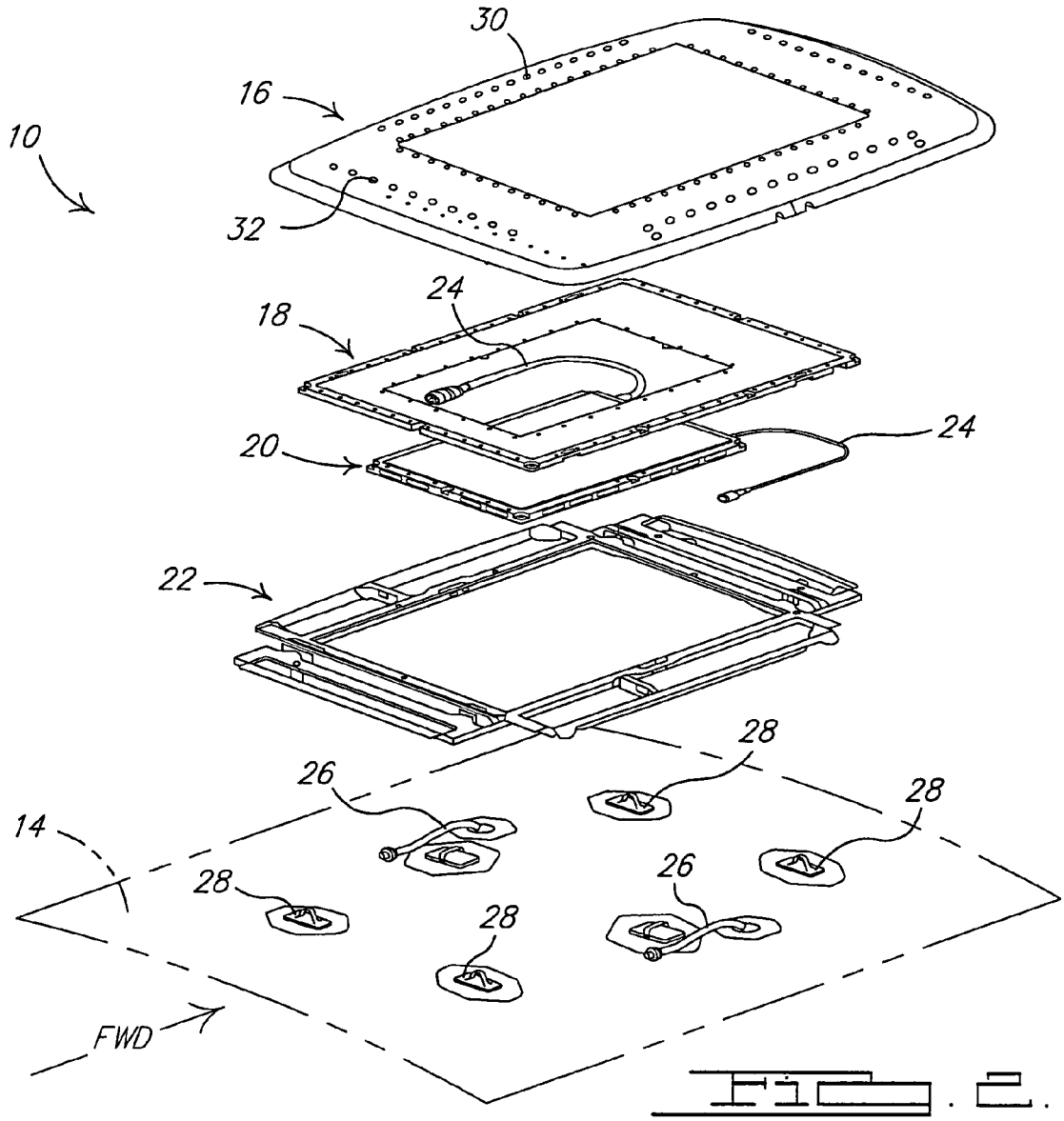
FIG. 2 is an exploded perspective view of the antenna aperture, the choke plate and related components to which the antenna aperture is mounted.

Referring now to FIG. 2, antenna system 10 is shown in exploded form. The antenna system 10 generally comprises an aerodynamically-shaped fairing 16, a choke plate 18, a transmit phased array antenna aperture 20, and an adapter plate 22. The adapter plate 22 supports the choke plate 18. The antenna aperture 20 is interfaced via conductors 24 to conductors 26 projecting through the skin of fuselage 14. Mounts 28 on the fuselage 14 secure to the adapter plate 22 to enable adapter plate 22 to be securely fixed to the fuselage 14. A plurality of fasteners 30 extend through a corresponding plurality of openings 32 in the fairing 16 to allow the fairing to be secured to the adapter plate 22.

Figure 3:
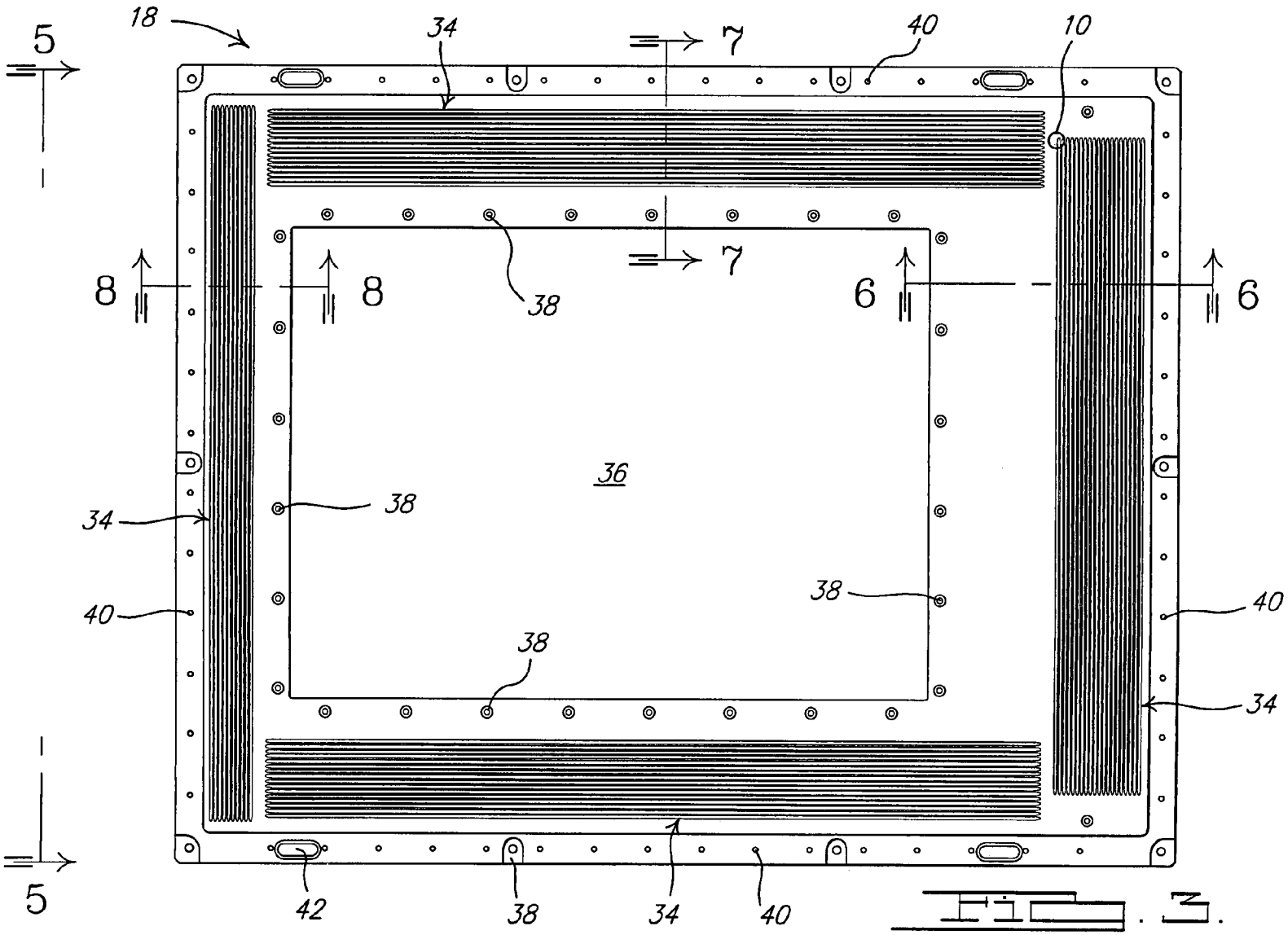
FIG. 3 is a plan view of an upper surface of the choke plate.

Referring now to FIG. 3, choke plate 18 can be seen to include a plurality of distinct groups of grooves 34. In example FIG. 3, four distinct pluralities of grooves 34 are illustrated; however, it will be appreciated that a greater or lesser plurality of grooves could be incorporated. It is anticipated that, to provide maximum RF signal attenuation at or below the horizon when the mobile platform is in flight, the grooves 34 should be disposed so as to completely circumscribe an opening 36 of the choke plate 18 within which the antenna aperture (not shown in FIG. 3) resides. The choke plate 18 also includes a plurality of holes 38 and 40 for securing to the fairing 16 (Note: Holes 38 mount the antenna/choke plate to the adapter plate. Holes 40 mount the fairing to the choke plate.—DNR) A plurality of elongated slots 42 are used for lifting straps in handling the assembled system 10.

Figure 4:
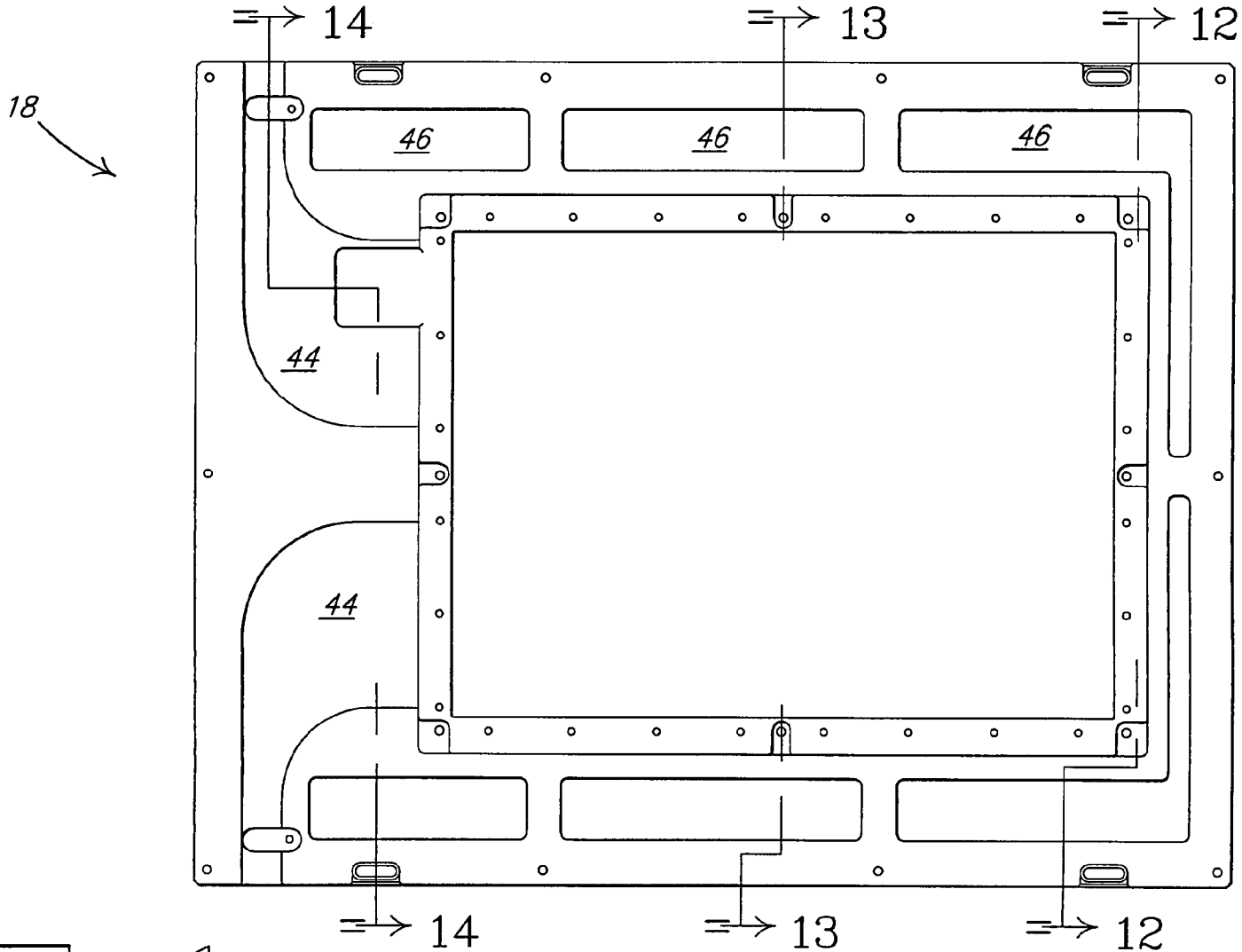
FIG. 4 is a plan view of the lower surface of the choke plate.
Figure 5:
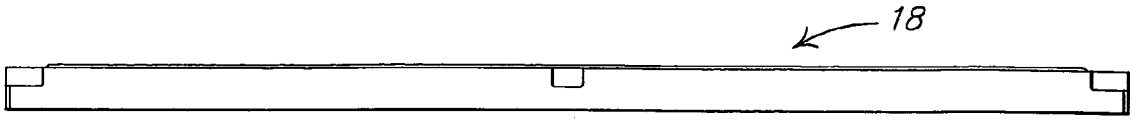
FIG. 5 is a side view of the choke plate taken in accordance with directional line 5-5 in FIG. 3.
Figure 6:
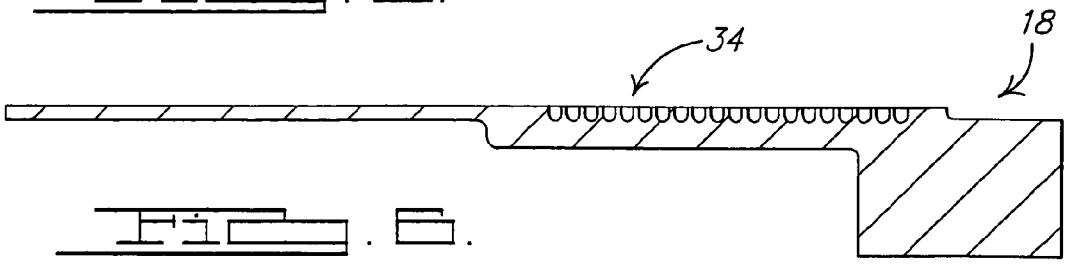
FIG. 6 is a cross-sectional view of a portion of the choke plate taken in accordance with section line 6-6 in FIG. 3.

Referring briefly to FIG. 4, an undersurface of the choke plate 18 is illustrated. The undersurface includes a plurality of scalloped areas 44 for wire routing and a plurality of elongated recesses 46 for weight reduction.

Figure 9:
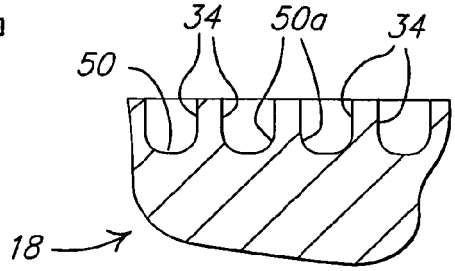
FIG. 9 is an enlarged view of a plurality of the grooves formed in the choke plate, taken in connection with circled area 9 in FIG. 7.

With further reference to FIGS. 3 and 6-14, the grooves 34 in the choke plate 18 can be seen in greater detail. With particular reference to FIG. 9, the grooves 34 have a depth that, in one preferred form, is ¼ wavelength of the operating frequency of the antenna aperture 20. In this example, for an operating frequency of about 14.0-14.4 GHz, the needed depth translates to about 0.100" (2.54 mm). Each groove 34 is further spaced apart by a distance of preferably about 0.05" (1.27 mm). Each groove 34 also preferably includes a bottom wall 50 (FIG. 9) having radial corners 50*a* and 50*b* to alleviate possible stress points in the material forming the choke plate 18. In one preferred form, the choke plate 18 is formed from alodyne aluminum. Other suitable materials include conductively coated or treated composite materials.

Figure 7:
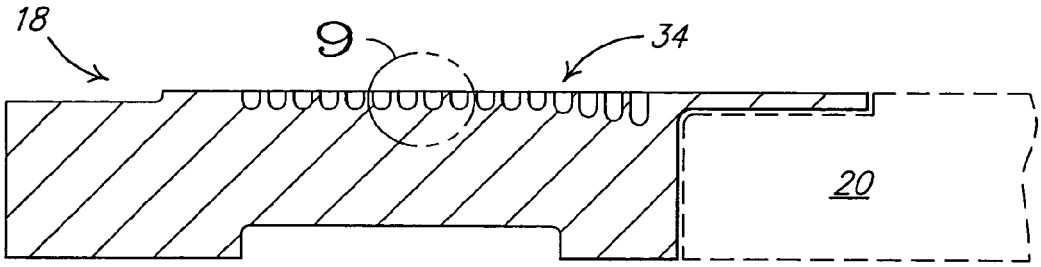
FIG. 7 is a cross-sectional view of a portion of the choke plate taken in accordance with section line 7-7 in FIG. 3.
Figure 8:
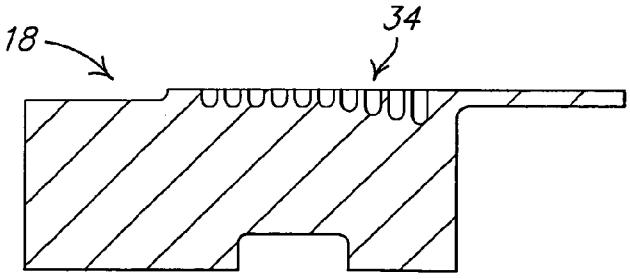
FIG. 8 is a cross-sectional view of a portion of the choke plate taken in accordance with section line 8-8 in FIG. 3.

Referring now to FIG. 7, it will be noted that choke grooves 34 have a slightly varying depth, with the deeper choke grooves 34 being employed at a distance radially closest to the location of the antenna aperture 20. Providing variable depths for the choke grooves 34 is a technique for specifically tailoring the choke grooves to a specific operational frequency of a given antenna aperture. The distance that the surface current has to flow through the choke grooves 34 is determined by the surface path length of each of the choke grooves 34. As this path length increases, the operational frequency influenced by the choke grooves 34 is lower; i.e., path length is directly proportional to the affected RF wave length which is proportional to the inverse of affected frequency. The choke grooves 34, in this example, are based on an operational center of the antenna being at approximately 14.2 GHz. Performance of the choke grooves 34 (i.e., their ability to cancel surface currents) typically falls off as the operational frequency deviates from the selected center frequency for which the choke grooves have been designed. Varying the depth of the choke grooves 34, as illustrated in FIG. 7, reduces the rate of sidelobe production performance roll-off as the antenna frequency is varied. The progressively deeper grooves operate primarily at the lower frequency band edge of the operating bandwidth of the antenna aperture 20. It will be appreciated that providing all of the choke grooves 34 with a uniform depth enables the choke plate 18 to operate satisfactorily, but with not quite the performance degree at this lower frequency band edge as can be accomplished with choke grooves have progressively greater depths.

Figure 11:
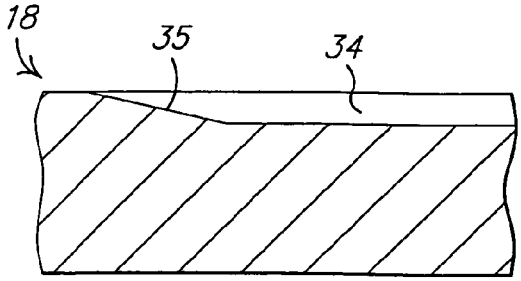
FIG. 11 is a partial cross-sectional view of one of the grooves of the choke plate illustrating an exemplary runout at one end of the groove, with the area of FIG. 11 represented by circled area 11 in FIG. 3.
Figure 12:
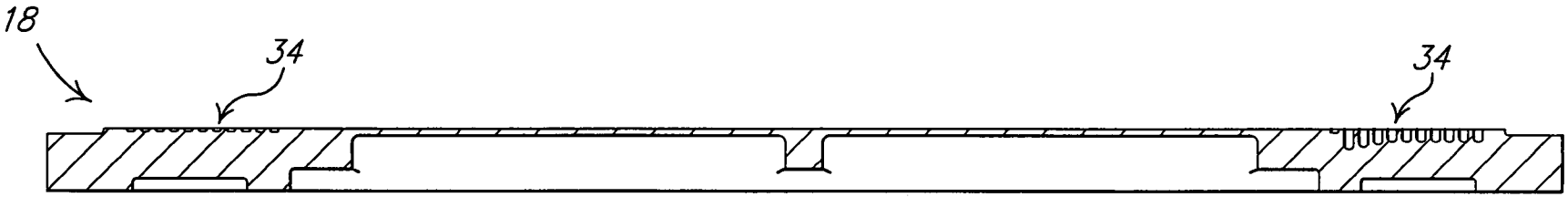
FIG. 12 is a cross-sectional view of the choke plate taken in accordance with section line 12-12 in FIG. 4.
Figure 13:
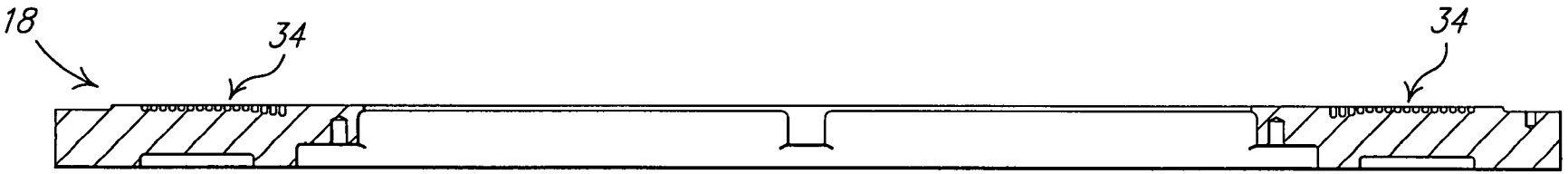
FIG. 13 is a cross-sectional view of the choke plate taken in accordance with section line 13-13 in FIG. 4.
Figure 14:
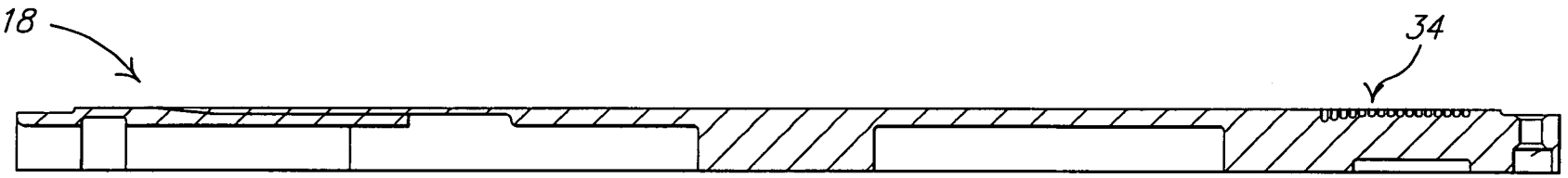
FIG. 14 is a cross-sectional view of the choke plate taken in accordance with section line 14-14 in FIG. 4.

With specific reference to FIG. 11, each of the choke grooves 34 preferably has a beveled bottom wall 35 at each end thereof for ease of machining the grooves.

Figure 10:
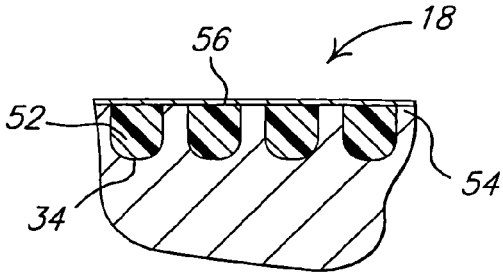
FIG. 10 illustrates the grooves being filled with a dielectric material and the upper surface of the choke plate covered with a layer of suitable paint or other environmental barrier.

With further reference to FIG. 10, each of the choke grooves 34 are further preferably filled with a dielectric material 52 and an entire upper surface 54 of the choke plate 18 is covered with a suitable weather-resistant paint 56. Various forms of dielectric materials may be used, but it is preferred that one that remains somewhat flexible after curing be employed. One suitable dielectric is BMS 5-95, available from PRC-DeSoto International, Inc. of Mohave, Calif. This material provides a dielectric constant (Er) of about ~3.75 at 14.50 GHz. The dielectric constant remains constant over a generally small frequency bandwidth. Specific supplier designations for dielectrics are available under the designations listed in the following table:

TABLE 1

| |
|---|
| PR 1432GP FL1; |
| Pro-Seal 870 B-2; |
| Pro-Seal 870 B-1/2; |
| Pro-Seal 870 C-20; |
| Pro-Seal 870 C-80; |
| Pro-Seal 870 C-168; |
| Pro-Seal 870 C-336; |
| Pro-Seal 870 Sprayable - 168 FL1 |

One environmental barrier layer 56 may also be provided from various paints, but one preferred coating layer is CMPCOAT CW4, which is also available from PRC-DeSoto International, Inc.

With specific reference to FIG. 9, the radial corners 50*a* and 50*b*, in one preferred form, have a radius of about 0.043" (1.09 mm), which minimizes the risk of fracture of the choke plate 18 during slight flexing of the choke plate. The scaled path length that defines the frequency which is influenced over a single choke groove 34 is generally consistent and the path length is measured by accounting for the side wall lengths and the arc length of bottom wall 50 and radiused corners 50*a*.

The paint layer (i.e., environmental barrier) 56 (in this example, CAAPCOAT CW4) is a standard radome paint, and is erosion-resistant and readily available from CAAP/CO Inc. of Milford, Conn. This coating is known to be suitable for external fuselage application, although any other suitable dielectric paint or dielectric coating material could be used.

It will be appreciated that the process of determining the precise depth and spacing of the grooves 34 is an iterative process. This process also takes into account the specific dielectric material used to fill the grooves 34. The materials selected for the dielectric can be used in any frequency as long as the real part of the dielectric constant is not too large; i.e., significantly larger than the value for free space which determines the performance of choke grooves 34 that are not filled. For optimum performance, it is anticipated that the optimum dielectric material should comprise a true dielectric, and not a semiconductor or conductor material.

Measured radiation patterns of the present invention have indicated that horizon/below-horizon sidelobe levels satisfy ETSI regulatory requirements. Installation of the choke plate 18 and fairing 16 of the present invention is aerodynamically sound and enables the operation of the choke plate 18 and fairing 16 installation outside of the United States, as well as within the United States.

Scattering of RF energy is a common problem on transmit antennas and radar. It is known that transmit antenna aperture induced surface currents, when present, can radiate into free space when an aperture discontinuity is encountered (i.e., sharp edges, etc.). This radiation into free space gives rise to unacceptable elevated/exaggerated radiation pattern sidelobes of the transmit beam, which can interfere with other antenna and equipment that is not intended to be affected.

As the main beam is scanned to small elevation angles, the amount of surface current excitation becomes greater, which results in greater sidelobe excitation whenever an aperture discontinuity is encountered. Many aerodynamic design tasks can benefit from the present invention, thereby reducing cost and flow time for installation. The present invention enables the use of fuselage-mounted high-gain antennas and makes the difference between using a phased array design option or not doing so.

The choke grooves 34 operate by making use of the periodic 180° phase reversal of the currents flowing over their surface, which cancels the surface currents to reduce the sidelobes to an acceptable level. It is the fact that surface currents cannot persist in the presence of the choke grooves 34 and, thus, reduced sidelobe levels are achieved.

The choke grooves 34 can be used at any operating frequency. The only limiting factor is the amount of physical space available to place a sufficient number of periodic grooves to provide a benefit. This is determined by creating grooves and measuring the resultant effect until the desired reduction of sidelobes is achieved. The choke dimensions between various frequency designs is determined by scaling using the general formula 1/(Er**2) as a scaling factor. Er is the real part of the complex dielectric constant. Free space air has a nominal Er of 1.0 in which the speed the light is the standard of 3×10^8 m/s. The equation $c=f\lambda$ must hold true. That is, c, the wave velocity, must equal the frequency of the propagating wave times the wave's wavelength. What is observed when this same free space propagating wave entered into a different dielectric medium is that the velocity reduces by 1/sqrt(Er). This reduction in velocity manifests itself as a reduction in both wavelength and frequency by 1/sqrt(Er). That is, by using the inverse of the square root of the dielectric constant of the loading materials where Er is the dielectric constant as a factor, a given choke design may be adapted to a different frequency. The scaling factor is, therefore, applied to both wavelength and frequency in order to obtain the reduction of wave velocity in the dielectric medium. The scaling factor is applied against the free space wavelength to obtain the wavelength in the dielectric medium, since a wavelength has the dimension of length that can be directly applied to the choke dimensions.

The choke plate 18 and groove 34 design is preferably periodic in nature and resides in the plane of the antenna aperture 20. Put differently, the upper surface of the choke plate 18 is generally coplanar, in one preferred form, with the upper surface of the antenna aperture 20 when these two components are secured to the fuselage 14.

With the choke plate 18, it is the surface currents of the choke plate 18 that are being removed or substantially minimized by the choke grooves 34 formed in the choke plate 18. The choke grooves 34 effectively serve to "choke," or cancel, surface currents that are generated as a result of operation of the transmit phased array antenna aperture 20 and discontinuities on the choke plate 18.

The dielectric material 52 used to fill the grooves 34 also serves to attenuate the surface currents in the choke plate 18 to a minor degree simply because it has a lossy component as part of its dielectric properties. However, the primary loss is due to the design dimensions of the choke plate 18 and its grooves 34. It will also be appreciated that the use of the dielectric filler material 52 is also helpful from an aerodynamic standpoint to provide a smooth upper surface for the choke plate 18, as well as to seal the choke grooves 34 to prevent the build-up of contaminants within the choke grooves.

Using the choke plate 18 without the dielectric filler material 52 may achieve similar results as those obtained with the dielectric filler material 52, but then the choke grooves 34 would be exposed to the air stream. This would introduce turbulence and drag, and would also present the problem of the choke grooves 34 possibly becoming clogged with dirt/debris since they would be exposed to the ambient environment. The transmit phased array antenna aperture 20 is intended to operate continuously along with a separate receive antenna, which is also operated continuously. The phased array transmit antenna aperture 20 of the present invention has a frequency bandwidth of about 2.8% from 14.0 GHz to about 14.4 GHz. The companion receive phased array antenna preferably has a frequency bandwidth of about 8.9% from 11.7 GHz to about 12.8 GHz. Preferably, the receive antenna frequency band is selected so as to be different from the transmit frequency so that the risk of interference, or swamping, of the receive antenna by the transmit antenna aperture 20, while both are operating at the same time, is minimized or eliminated.

With present receive antenna systems, the need for antenna sidelobe reduction is minimal. However, the antenna system 10 described herein is not limited to use with only transmit antennas, but could just as readily be employed with receive antenna. Presently, interference received through a receive sidelobe is generally system noise and accounted for in other known ways. Accordingly, aperture choking of a receive antenna is possible, but currently not necessary.

Figure 15:
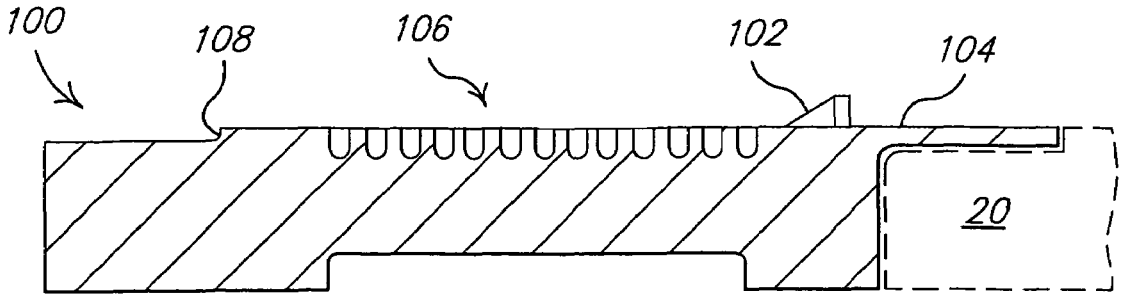
FIG. 15 is a view of a portion of an alternative preferred form of the choke incorporating a fence adjacent the grooves in the upper surface of the choke plate.

Referring now to FIG. 15, a cross-sectional view of an alternative preferred form of choke plate 100 is illustrated in which a beveled edge 102 is employed adjacent the antenna aperture 20 on an upper surface 104 of the choke plate. The beveled edge 102 preferably has a minimal 2:1 (width/height) bevel. The beveled edge 102 may be formed, in whole or in part, by a suitable dielectric material, such as that described herein. The beveled edge 102 may be employed to minimize the aerodynamic effect (i.e., lower the drag) for choke grooves 106 positioned perpendicular to the airflow over the choke plate 100, as well as to reduce drag in the longitudinal direction when the aircraft sideslips. Thus, in this alternative embodiment, the beveled edge 102 would be employed along all four sides of the opening 36 of the choke plate 18 shown in FIG. 3. A step 108 is incorporated along each group of grooves 106 to allow the fairing 16 surface to be installed flush further improve RF performance in concert with the grooves 106.

Figure 16:
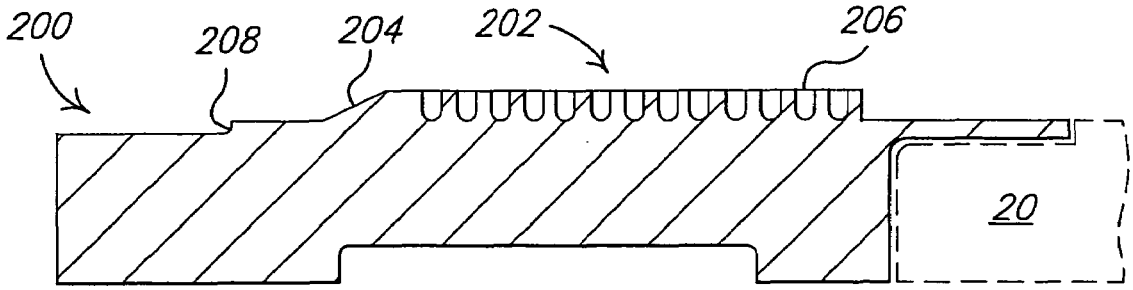
FIG. 16 is another alternative preferred embodiment of the choke plate illustrating a beveled edge on an upper surface of the choke plate, with the grooves being formed in a plane that resides above the upper surface of the antenna aperture with which the choke plate is used.

FIG. 16 illustrates a cross-sectional view of choke plate 200 in accordance with another alternative preferred embodiment of the present invention. Choke plate 200 includes raised choke grooves 202, each having a depth of about 0.112" (2.84 mm). A beveled edge 204 is also formed at a radially outward area of each group of choke grooves 202. Upper surface 206 of each choke groove 202 is thus positioned above an upper surface of antenna aperture 20. The bevel of beveled edge 204 is preferably similar to the degree of bevel provided at beveled edge 102. Step 208 may be of similar dimensions to step 108.

Figure 17:
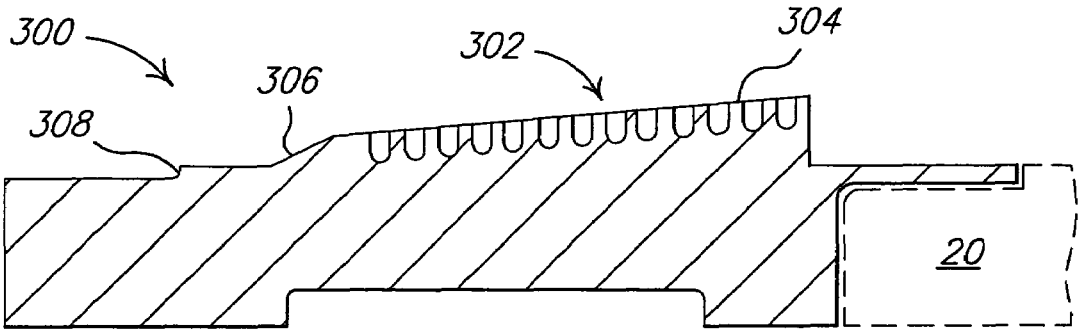
FIG. 17 is another alternative preferred form of the choke plate wherein the grooves are formed along a plane that is beveled with respect to the upper surface of the antenna aperture and the perimeter edge of the choke plate.

In FIG. 17, a choke plate 300 in accordance with another alternative preferred embodiment is illustrated. Choke plate 300 includes choke grooves 302, each having a depth of about 0.112" (2.84 mm), but the grooves are arranged along the section of the material to provide a beveled overall upper surface 304. An additional beveled edge 306 and step 308 are also provided. Step 308 may be of similar dimensions to step 108.

Figure 18:
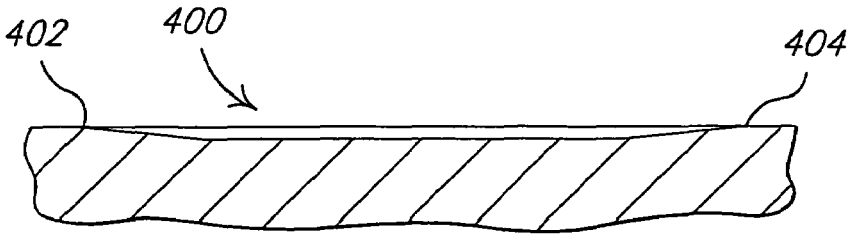
FIG. 18 is a side view of an alternative preferred form of the choke plate illustrating beveled leading and trailing edges.

FIG. 18 illustrates a side view of a choke plate 400 in accordance with an alternative preferred embodiment of the present invention, in which a minimum 10:1 (length/height) bevel at leading edge 402 and trailing edge 404 is employed to minimize the choke effects on aerodynamic performance, i.e., drag.

Figure 19:
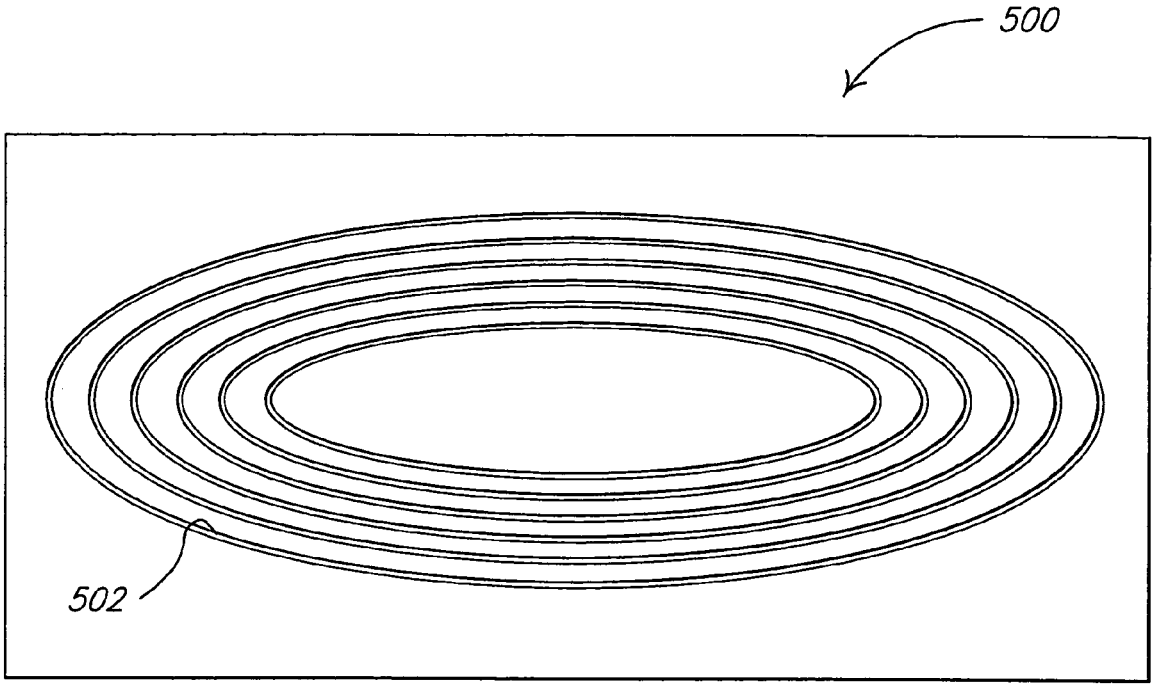
FIG. 19 is a plan view of an alternate preferred form of the choke plate incorporating oval-shaped grooves.

With brief reference to FIG. 19, a simplified illustration of an alternative preferred choke plate 500 is illustrated, employing oval-shaped choke grooves 34.

Figure 20:
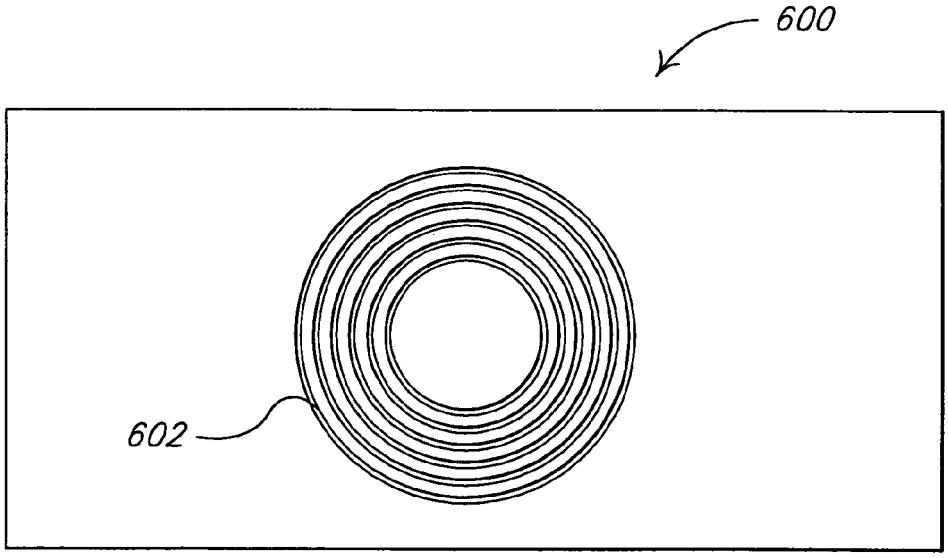
FIG. 20 is a plan view of an alternate preferred form of the choke plate incorporating round grooves.

FIG. 20 shows a simplified illustration of an alternative preferred choke plate 600, employing circular choke grooves 602. From FIGS. 19 and 20, it will be appreciated that the choke grooves do not need to be linear.

From the foregoing, it will be appreciated that there is essentially no set formula for the design of a specific RF choke. However, a principally important consideration is the establishment of initial conditions (¼ wavelength) and an iterative analysis of performance determined by test and incremental changes to achieve the desired degree of sidelobe attenuation. Accordingly, the size and shape of the choke grooves 34 are dictated, in large part, by the specific frequencies to be employed with the antenna aperture with which the choke plate 18 is being used.

Figure 21:
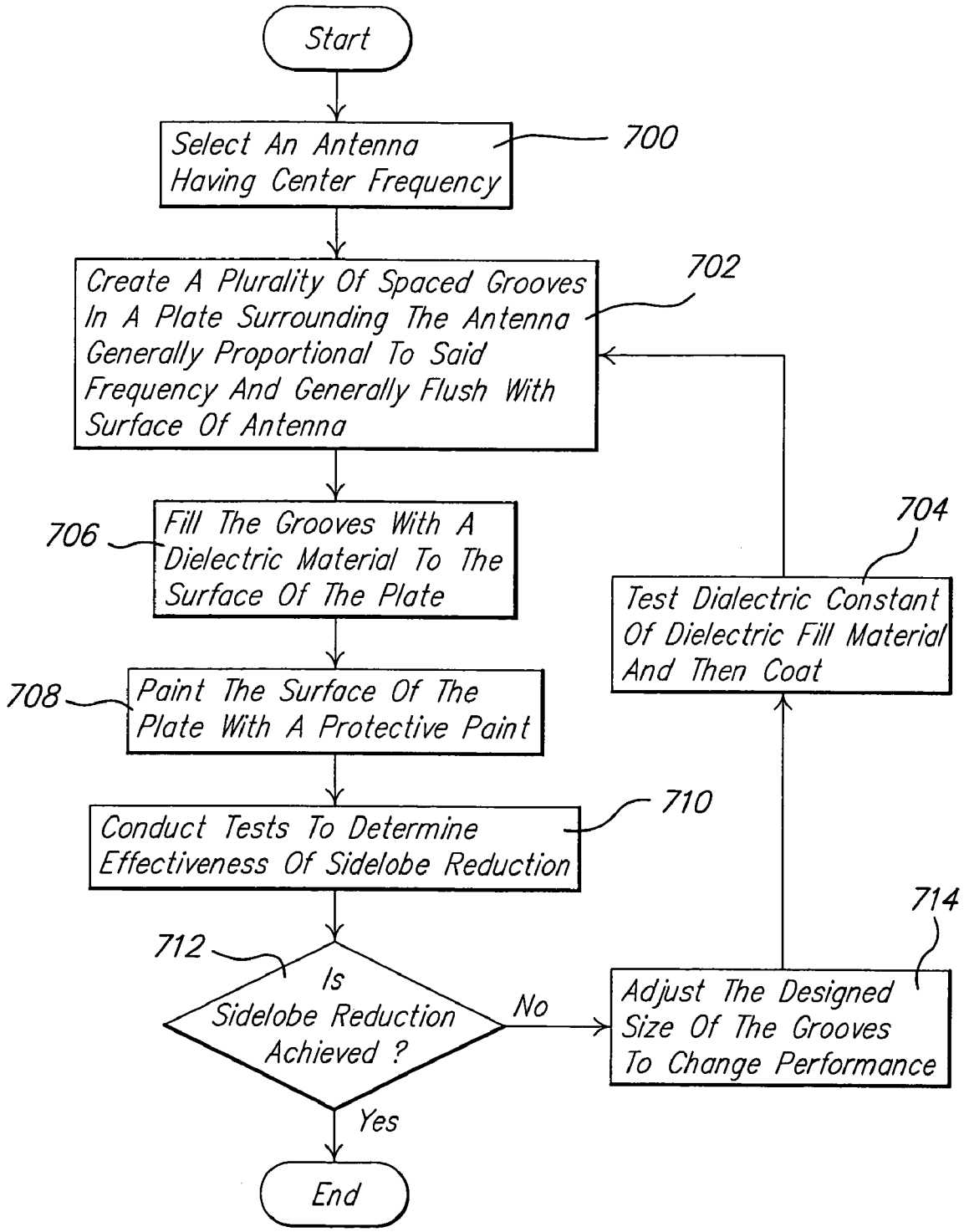
FIG. 21 is a simplified flow chart of the steps taken in designing the choke plate.

The choke design starting point, as shown in FIG. 21, is to determine the frequency and apply a ¼ wavelength groove depth because the currents induced on the choke groove 34 destructively interfere with each other by the fact that the depth of the groove is at about 90° relative to the direction of propagation of the surface currents. That is, surface currents flowing in opposite directions (i.e., those that flow radically outward away from the aperture 20 and those reflected from each choke grooves 34 edge discontinuity flowing inwardly) will destructively interfere with each other since they are then 180° out of phase. If they are equal in amplitude, the result is zero. Thus, with the choke plate 18, the surface currents simply cease to exist and, thus, cannot radiate into free space to create or enhance the fundamental radiation pattern sidelobes.

For vertical antenna polarization with no chokes installed, the electric field vector is normal to the surface of the aircraft skin, and can maintain a finite magnitude at the surface (i.e., no "short circuiting" of the fields for this polarization). For this reason, the vertically-polarized below-horizon pattern levels with no chokes installed will be very much higher than for horizontal polarization.

The function of the choke grooves 34, with narrow slots approximately a quarter-wavelength deep around the antenna aperture 20, is to modify the "boundary conditions" such that the behavior is generally identical for both horizontal and vertical polarization, and generally equivalent to the behavior of a simple, smooth metal surface for horizontal polarization. The choke plate 18 essentially "short circuits" the vertically-polarized fields and dramatically reduces the below-horizon pattern levels so that they become similar to the horizontally-polarized levels.

For airborne horizontal antenna polarization, the choke grooves 34 have little effect, and test range measurements demonstrate that the patterns below the horizon are virtually unaffected for horizontal polarization when choke grooves 34 are included. This effect results from the installed "environment" of the airborne antenna on the conducting (aluminum) aircraft fuselage skin. Thus, the horizontal polarization electric-field vector will be tangential to the fuselage surface, and must drop to zero at the surface itself. In effect, the metal skin of the aircraft is choking or "short circuiting" the horizontally-polarized antenna fields. This gives rise to relatively low below-horizon sidelobe levels for the transmit phased array installed on the aircraft without choke grooves 34.

Referring further to FIG. 21, the operations in designing the choke plate 18 are illustrated. An initial design of the choke grooves 34 at ¼ frequency depth and width is created at operation 702, with approximately a ⅛ frequency distance separation or less between grooves 34. The initial form of the choke grooves 34 in cross-section is square; however, radial corners 50*a* at the bottom of each groove 34 are introduced to resist fracture due to flexing and vibration of the choke plate 18. The dielectric constant for the dielectric filler material 52 and paint (or other environmental barrier) 56 are tested for the center of frequency or above compatibility, as indicated at operation 704.

Small adjustments may be made in the design of the choke plate 18 to modify the depth of the choke grooves 34 to account for the presence of the dielectric material 52. The choke grooves 34 are filled with dielectric material 52 so as to be level with the upper surface of the choke plate 18, as indicated at operation 706. Dielectric paint (or other environmental barrier) 56 is then applied at operation 708 so that the entire upper surface of the choke plate 18 is covered with the dielectric paint. The use of the dielectric material 8 for aerodynamic and contamination protection loads the choke plate 18 and changes the effective size of the choke grooves 34 relative to the wavelength. The loading must be accounted for by a change in the size of the groove 34 geometry. The resulting structure is then tested as operation 710 to determine the degree of improvement of sidelobe production. At operation 712, a determination is made if a sufficient degree of sidelobe reduction has been achieved. If not, the overall choke plate design is modified slightly, as indicated in operation 112 before again repeating operations 704-712.

Figure 22:
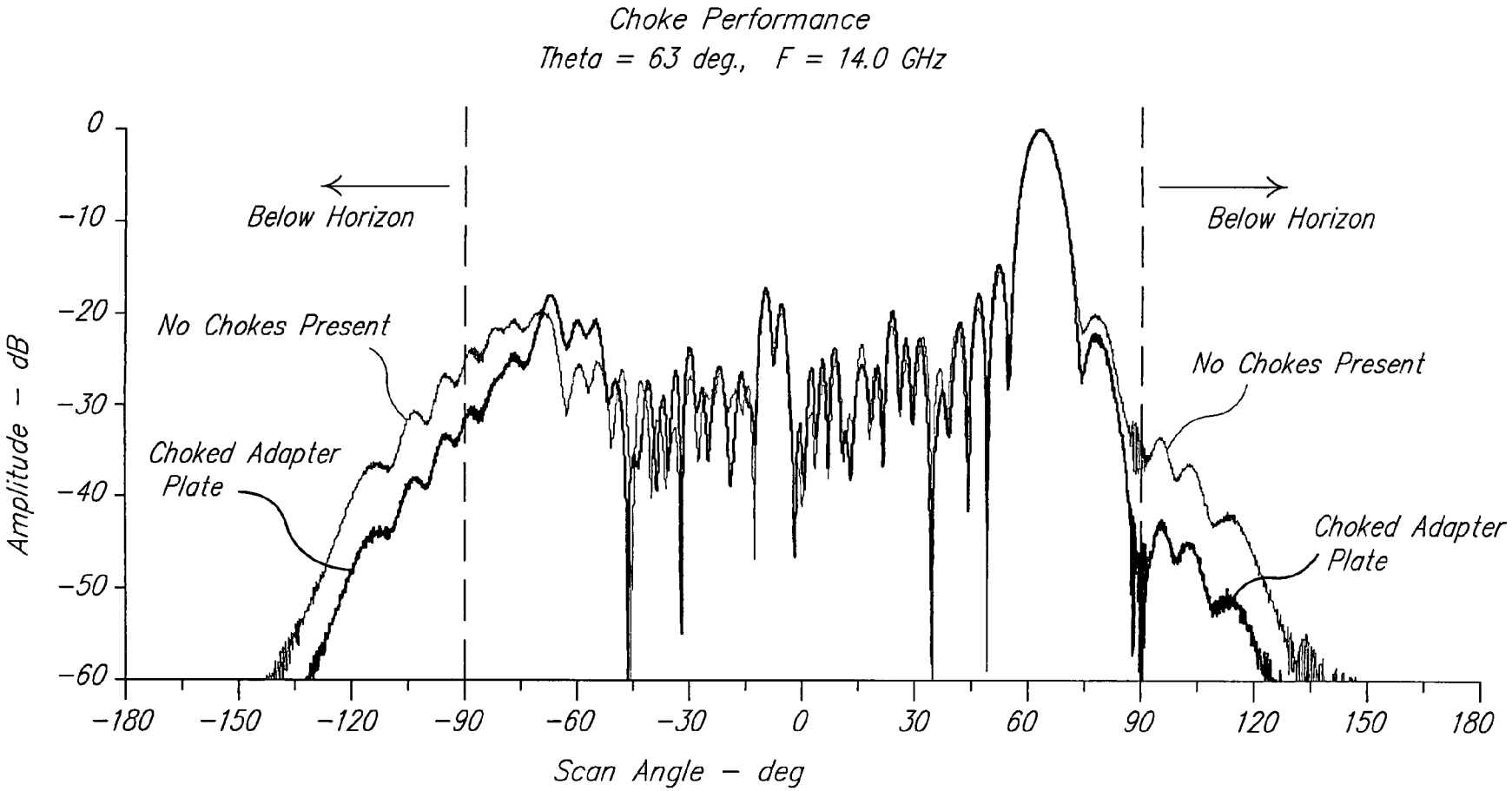
FIGS. 22-24 are graphs illustrating the signal attenuation provided by the choke plate at frequencies of 14.0 GHz, 14.2 GHz and 14.4 GHz, respectively.
Figure 23:
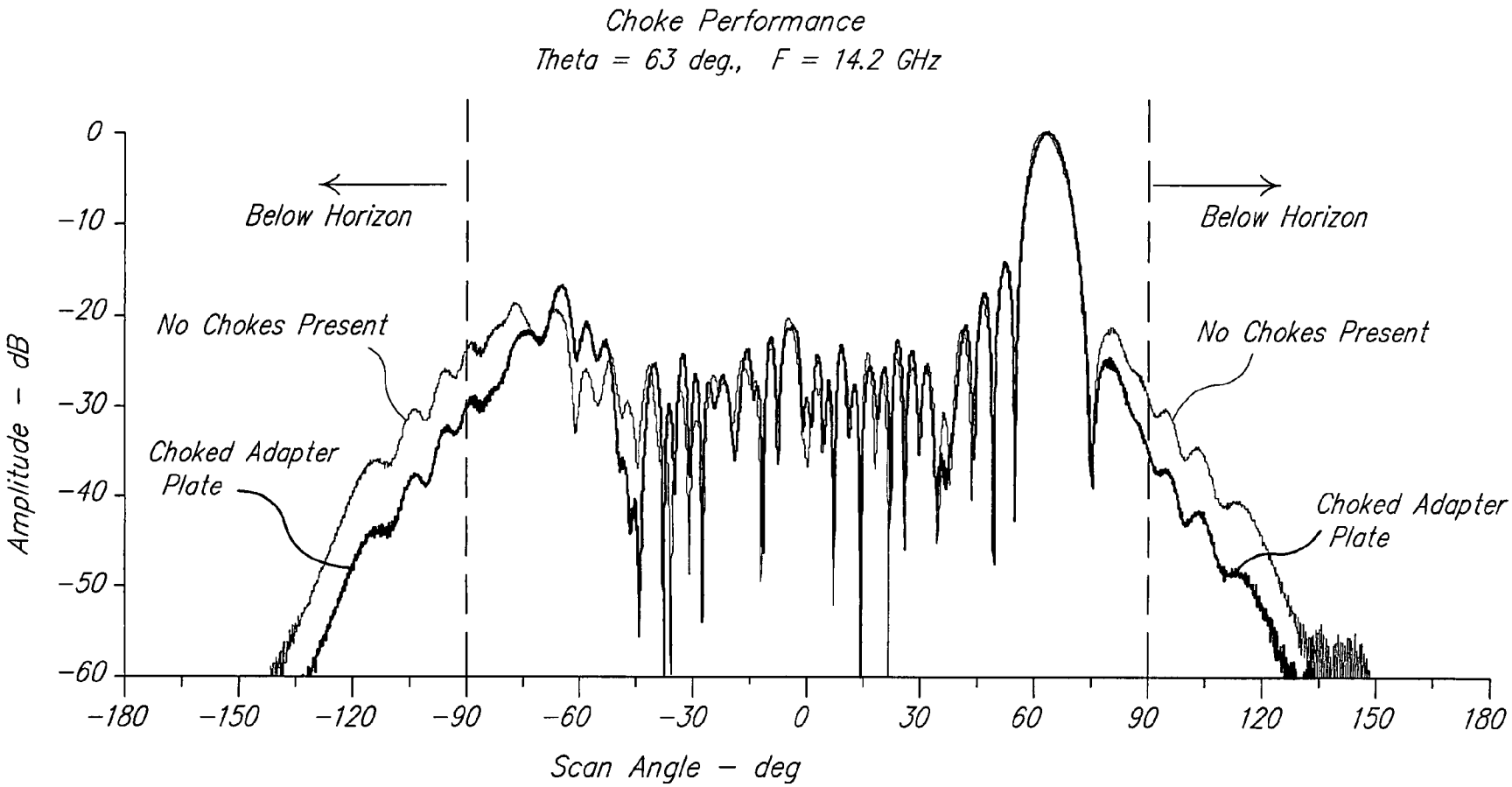
Figure 24:
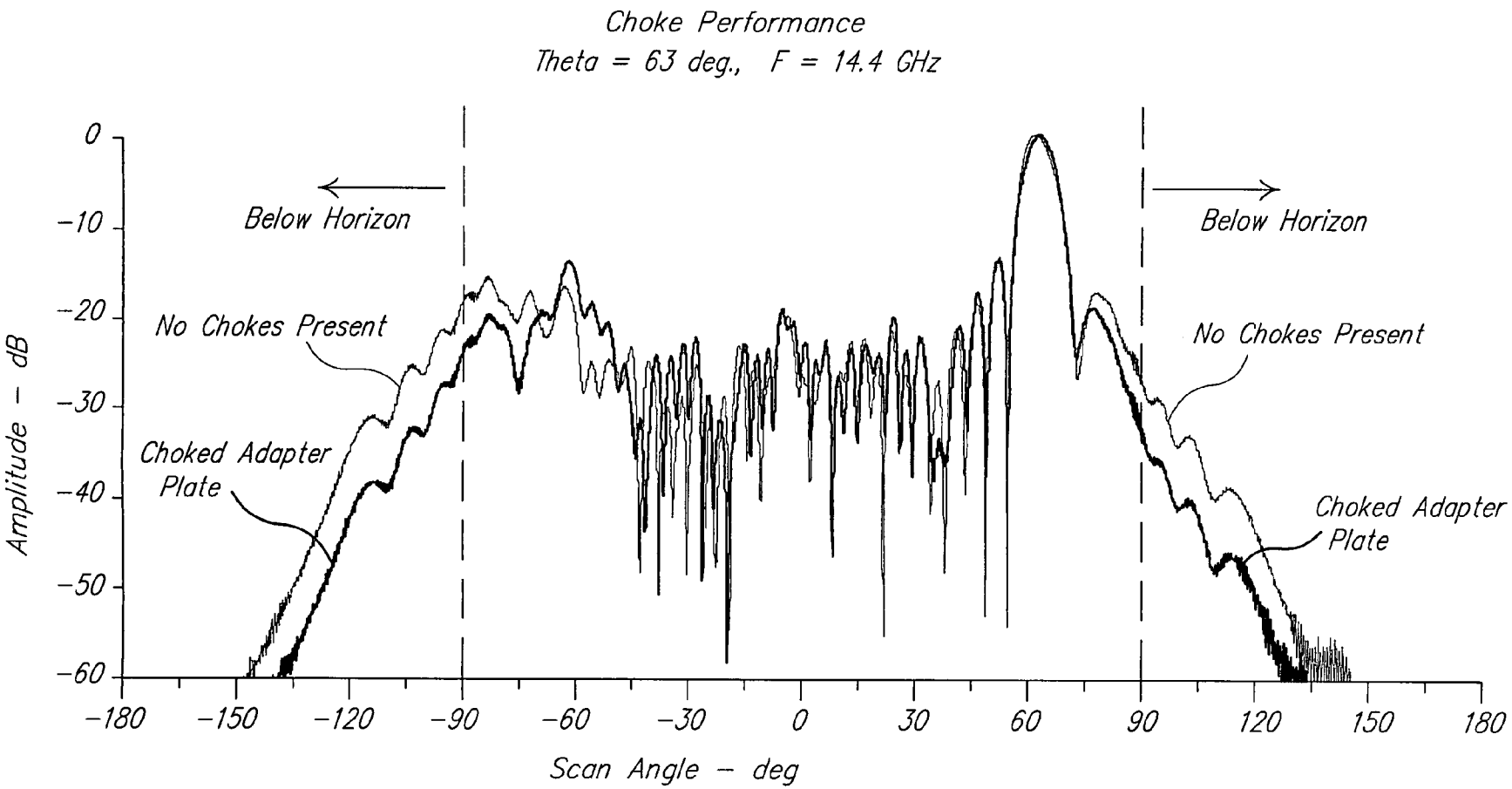

Referring now to FIGS. 22-24, the measured performance of the choke plate 18 can be seen at three frequencies (i.e., at 14.0 GHz, 14.2 GHz and 14.4 GHz). From FIGS. 22-24, the attenuation of the sidelobe level below the horizon can be seen. The three figures are for the three frequencies which represent the lower, mid, and upper transmit band frequencies. At each frequency the amplitude of the sidelobes are seen to be lowered at angles close to the horizon, i.e., −140 to −70 and 70 to 140.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. An antenna choke apparatus adapted for use with an antenna aperture on an exterior surface of an airborne mobile platform, the apparatus comprising:

a choke plate having an area for circumscribing at least a portion of said antenna aperture, the choke plate having a thickness such that when said choke plate and said antenna aperture are mounted on said exterior surface, an upper surface of said choke plate is disposed at a desired height relative to an upper surface of said antenna aperture;

a plurality of grooves formed in said upper surface of said choke plate for attenuating electromagnetic wave (EM) radiation from said antenna aperture below a predetermined elevation angle; and wherein each of said grooves has a bottom wall with radiused corners.

2. The apparatus of claim 1, wherein said predetermined elevation angle comprises an elevation angle below which said EM radiation would reach a ground surface of the earth.

3. The apparatus of claim 1, wherein said area of said choke plate for circumscribing at least a portion of said antenna aperture includes an opening for completely circumscribing said antenna aperture.

4. The apparatus of claim 3, wherein said grooves substantially circumscribe said opening.

5. The apparatus of claim 1, wherein each of said grooves has a depth of approximately one quarter wavelength of the operating frequency of the phased array antenna.

6. The apparatus of claim 1, wherein said grooves are each filled with a dielectric material up to a point flush with said upper surface of said choke plate.

7. The apparatus of claim 1, wherein said plurality of grooves have different depths.

8. The apparatus of claim 1, further comprising an environmental protection barrier applied over said upper surface of said choke plate.

9. The apparatus of claim 1, wherein said grooves are arranged parallel to one another.

10. An antenna choke apparatus adapted for use with a phased array antenna aperture on an exterior surface of an airborne mobile platform, the apparatus comprising:

a choke plate having a generally centrally formed opening for circumscribing said antenna aperture, the choke plate having a thickness such that when said choke plate and said antenna aperture are mounted on said exterior surface, said choke plate forms a generally radial extension of said antenna aperture generally co-planar with said antenna aperture;

a plurality of parallel grooves formed in an upper surface of said choke plate for attenuating electromagnetic wave (EM) radiation from said antenna aperture below a predetermined elevation angle, said grooves being disposed about substantially an entire perimeter of said antenna aperture;

each of said grooves having a depth of at least about one quarter wavelength of an operating frequency of the antenna aperture;

each of said grooves being filled with a dielectric material so that said dielectric material is generally co-planar with said upper surface of said choke plate; and wherein said choke plate has a beveled edge to form an aerodynamic surface.

11. The antenna choke apparatus of claim 10, wherein said grooves have varying depths, with deeper ones of said grooves being arranged radially farther from said antenna aperture than shallower ones of said grooves.

12. The antenna choke apparatus of claim 10, further comprising an environmental protection coating applied over said upper surface of said choke plate.

13. The antenna choke apparatus of claim 10, wherein said beveled edge is disposed parallel to certain ones of said grooves.

14. The antenna choke apparatus of claim 10, further comprising a raised rib projecting from an upper surface of said choke plate parallel to certain ones of said grooves for enhancing radio frequency performance of said choke plate, i.e., further reduction of sidelobes.

15. A method for attenuating electromagnetic (EM) wave radiation from an antenna aperture mounted on an exterior surface of a mobile platform, where the EM wave radiation is attenuated below a predetermined elevation scan angle of the antenna aperture to prevent interference with ground-based EM wave systems, the method comprising:

disposing a metallic plate having a generally centrally formed opening over said antenna aperture to circumscribe a perimeter of said antenna aperture;

forming a plurality of grooves in an upper surface of said metallic plate, each of said grooves having a depth of at least about one quarter wavelength of an operating frequency of said antenna; and forming one edge of said metallic plate with a beveled edge to act as an aerodynamic surface.

16. The method of claim 15, further comprising filling said grooves with a dielectric material so that said upper surface of said metallic plate is substantially smooth.

17. The method of claim 15, further comprising providing said grooves with varying depths.

18. An airborne mobile platform comprising:

an antenna aperture adapted to be mounted to an exterior surface of said mobile platform;

a choke plate having a generally centrally disposed opening for receiving said antenna aperture, said choke plate being adapted to be mounted to said exterior surface of said mobile platform such that an upper surface of said choke plate is substantially co-planar with an upper surface of said antenna aperture; and a plurality of grooves formed in said upper surface of said choke plate at least substantially circumscribing said opening; each of said grooves having a depth of approximately one quarter wavelength of an operating frequency of said antenna aperture, and a bottom wall of each said groove having radiused corners.

* * * * *

UNITED STATES PATENT AND TRADEMARK OFFICE

CERTIFICATE OF CORRECTION

PATENT NO. : 7,295,165 B2
APPLICATION NO. : 11/212399
DATED : November 13, 2007
INVENTOR(S) : Stanley D. Ferguson et al.

It is certified that error appears in the above-identified patent and that said Letters Patent is hereby corrected as shown below:

Title Page: item [30] Insert:

--Related U.S. Application Data

Provisional application No. 60/673,846, filed on April 22, 2005--

Signed and Sealed this

Thirtieth Day of June, 2009

JOHN DOLL
*Acting Director of the United States Patent and Trademark Office*